US007001283B2

(12) United States Patent
Jeong

(10) Patent No.: US 7,001,283 B2
(45) Date of Patent: Feb. 21, 2006

(54) TRAINING MACHINE FOR GOLF SWING

(76) Inventor: Yun Jeong Jeong, 324-102, Olympic APT., 89, Bangi-dong, Songpa-gu, Seoul (KR)

( * ) Notice: Subject to any disclaimer, the term of this patent is extended or adjusted under 35 U.S.C. 154(b) by 0 days.

(21) Appl. No.: 11/039,435

(22) Filed: Jan. 20, 2005

(65) Prior Publication Data

US 2005/0261070 A1 Nov. 24, 2005

(30) Foreign Application Priority Data

May 24, 2004 (KR) ..... 10-2004-0036914

(51) Int. Cl.
*A63B 57/00* (2006.01)

(52) U.S. Cl. ..... 473/219; 473/221

(58) Field of Classification Search ..... 473/219, 473/220, 221, 222, 224, 226, 233, 234, 333, 473/223; 73/492
See application file for complete search history.

(56) References Cited

U.S. PATENT DOCUMENTS 3,215,437 A * 11/1965 Webb ..... 473/234
4,614,343 A * 9/1986 Radway ..... 473/234
4,967,596 A * 11/1990 Rilling et al. ..... 73/492
5,074,564 A * 12/1991 Rilling ..... 473/234
5,082,283 A * 1/1992 Conley et al. ..... 473/234
5,131,660 A * 7/1992 Marocco ..... 473/220
5,169,151 A * 12/1992 Conley ..... 473/220
5,259,620 A * 11/1993 Marocco ..... 473/224
5,277,428 A * 1/1994 Goodwin et al. ..... 473/224
5,435,561 A * 7/1995 Conley ..... 473/224
6,012,988 A * 1/2000 Burke ..... 473/224

* cited by examiner

*Primary Examiner*—Nini F. Legesse
(74) *Attorney, Agent, or Firm*—Keusey, Tutunjian & Bitetto, P.C.

(57) ABSTRACT

A training machine for golf swing includes a plurality of magnets provided in the opposite position to the grip; a collision device attachable to the magnets, and adapted to be separated from the magnets and collided with other objects by the centrifugal force more than a prescribed intensity and the instant swing speed upon swing; a magnetic force control device associated with the magnets and for controlling the intensity of magnetic force affecting the magnetic body from the magnets; an announcement mechanism positioned apart with the magnetic body, and for announcing the separation of the magnetic body and the magnets to contact the magnetic body when the magnetic body is separated from the magnets; and whereby a user can easily confirm by the announcement whether a swing more than a prescribed intensity was made to correspond to the intensity of magnetic force controlled by the magnetic force control device.

15 Claims, 9 Drawing Sheets

TRAINING MACHINE FOR GOLF SWING

FIELD OF THE INVENTION

The present invention generally relates to a training machine for golf swing. More specifically, the present invention relates to a training machine for golf swing where a user can realize an impact that the centrifugal force more than a prescribed intensity are consistent with the highest point of speed of swing, can control the intensity of swing to conform to the distance (driver distance) desired by the hit of a ball, and can train for the correct swing posture.

BACKGROUND OF THE INVENTION

Generally, golf is a game in which users hit, by a club, a ball which is stationary and put on the course and insert the ball into prescribed holes, and the outcome thereof is concluded according to the number of hits made in the game. It is a general tendency that golf has become more popular as the sport can be enjoyed outdoors.

Because users can take advantage of training courses, which are close to home, for the training of golf, there is greater availability for golf training by the persons who are interested in golf or have trouble in getting to or having time to get to a golf course.

However, it is difficult for users to find time and go to golf training courses in order to adjust the posture of swing or a point of impact.

Consequently, there has been developed a lot of training machines for golf swing that user can correct easily his swing posture at home. Among the training machines for golf swing, one example titled "a training machine for golf swing" is disclosed in the Korean utility model registration No. 345643.

As disclosed, a traditional training machine for golf swing including a head portion 100 and a hollow body portion 200 comprises a fixing element 400 positioned on an end of the hollow body portion 200 toward the head portion 100; a movable element 600 positioned and freely movable within the hollow body portion 200; a spring 700 for connecting the movable element 600 to the hollow body portion 200 within the hollow body portion 200; and one end of the spring 700 is fixed to an end of the hollow body portion 200 toward the grip and the other end of the spring is connected to the movable element 600.

According to the traditional training machine for golf swing as constructed above, if a user grasps the grip and swings the golf club, the movable element 600 may be extended by the centrifugal force to overcome the resistance of the spring 700.

However, in the above-mentioned traditional training machine for golf swing, the centrifugal force that is initially generated at an initial stage of swing and increased gradually will be all reflected to the spring. In this case, if the speed of swing is fast, the movable element will collide with the fixing element well before a point of impact. Thus, an instant where the impact of the centrifugal force and the swing speed is maximized cannot be realized. In addition, when motion of swing is inadequately carried out due to a shake or weakness of the swing, the centrifugal force will not overcome the elastic force of spring to make the movable element to make contact to the fixing element.

Further, in order to make the moveable element overcome the elastic force of spring, a user should always swing a golf club with regular force regardless of the instant of impact that the centrifugal force and the swing speed are maximized. This may enable the user to correct his posture of swing regardless of the driver distance. However, it is impossible for the user to train the intensity of swing to conform to the distance desired by the hit of a ball. Furthermore, the precise impact cannot be realized because the user cannot identify the instant of impact of the hit that the centrifugal force and the swing speed are maximized due to the centrifugal force that is gradually increased from the initial stage of the swing.

SUMMARY OF THE INVENTION

Accordingly, the present invention is intended to solve the above disadvantages associated with the prior art. It is an object of the present invention to provide a training machine for golf swing wherein a user can realize a precise impact, control the intensity of swing to conform to the distance desired by the hit of a ball, and train the correct swing postures.

To this end, the training machine for golf swing according to the present invention including a club shaft having a grip at a top end thereof, and a club head engaged with a lower end of the club shaft, comprises a plurality of magnets provided in the opposite position to the grip; a collision means attachable to the magnets, and adapted to be separated from the magnets and collided with other objects by the centrifugal force more than a prescribed intensity and the instant swing speed upon the swing; a magnetic force control means associated with the magnets and for controlling the intensity of magnetic force affecting a magnetic body from the magnets; and an announcement means positioned apart with the magnetic body, and for announcing the separation of the magnetic body and the magnets to contact the magnetic body when the magnetic body is separated from the magnets. Thus, a user can easily confirm by the announcement means whether a swing more than a prescribed intensity was made to correspond to the intensity of magnetic force controlled by the magnetic force control means.

DETAILED DESCRIPTION OF THE PREFERRED EMBODIMENTS

The above-mentioned features and operations of the structures will be described in detail with reference to the preferred embodiments of the training machine for golf swing according to the present invention.

Figure 1:
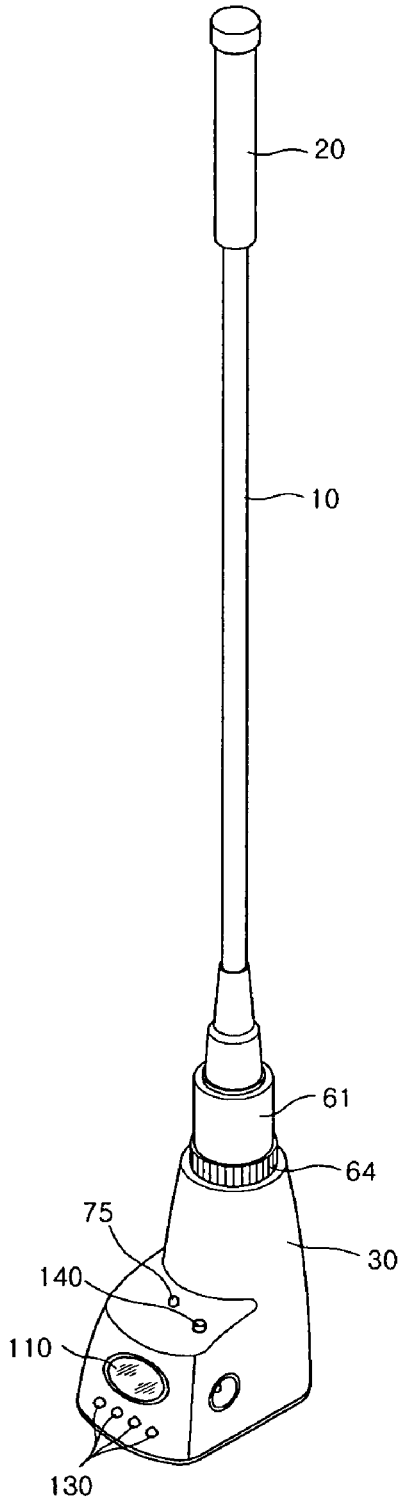
FIG. 1 is a perspective view of a training machine for golf swing according to a first embodiment of the present invention.
Figure 2:
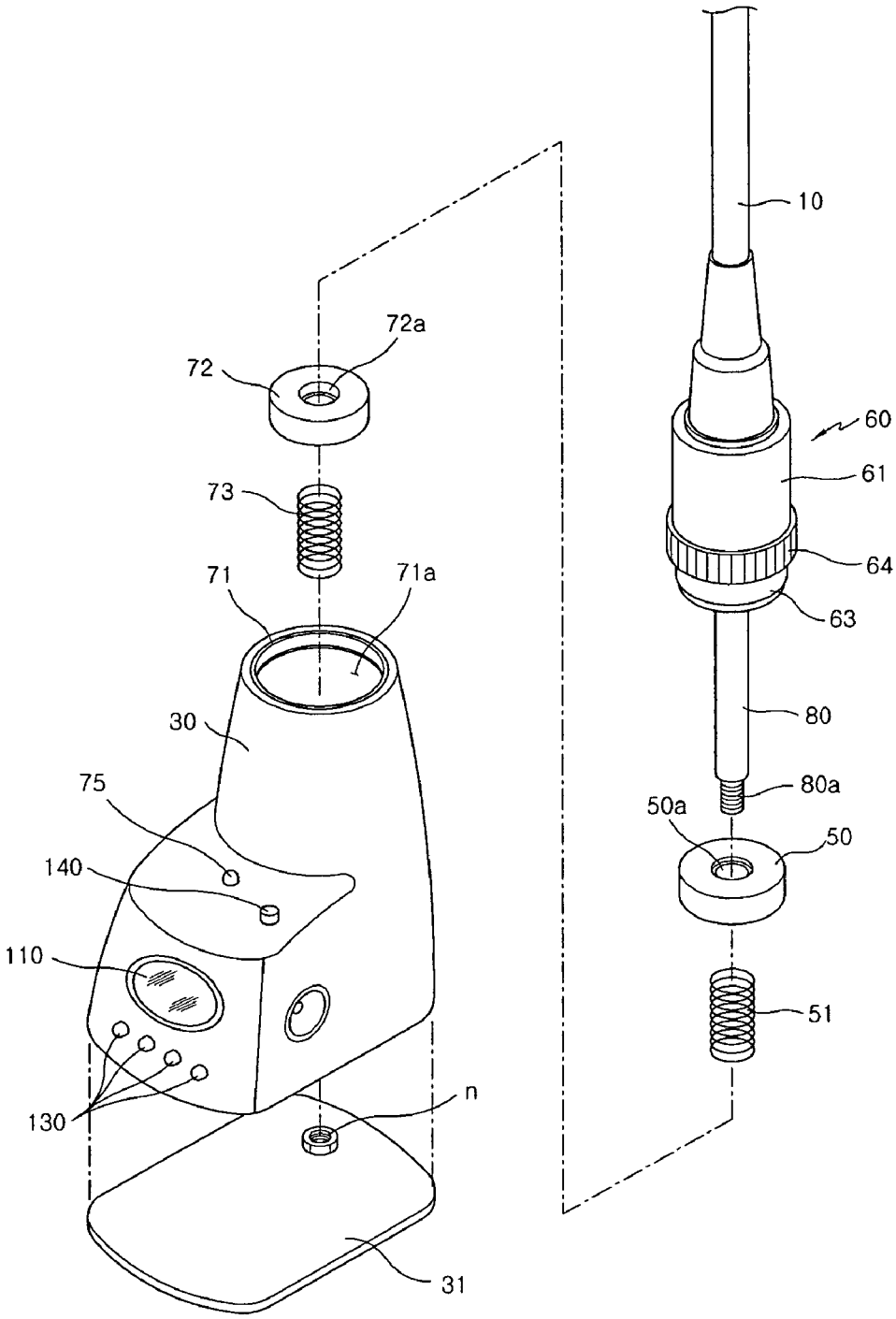
FIG. 2 is an exploded perspective view of a training machine for golf swing according to the first embodiment of the present invention.
Figure 3:
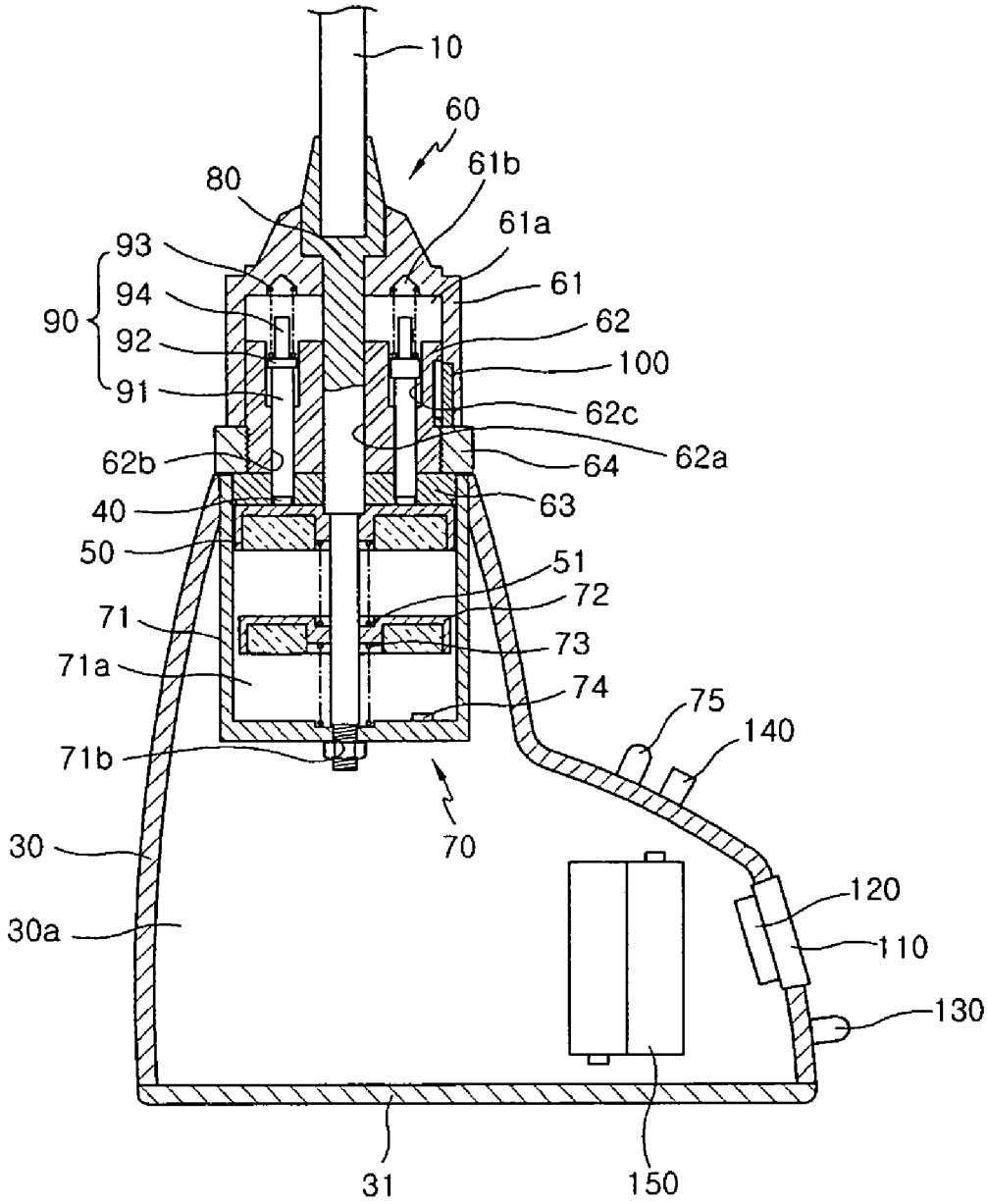
FIG. 3 is a cross-sectional view showing inner structures of main features shown in FIGS. 1 and 2.
Figure 4:
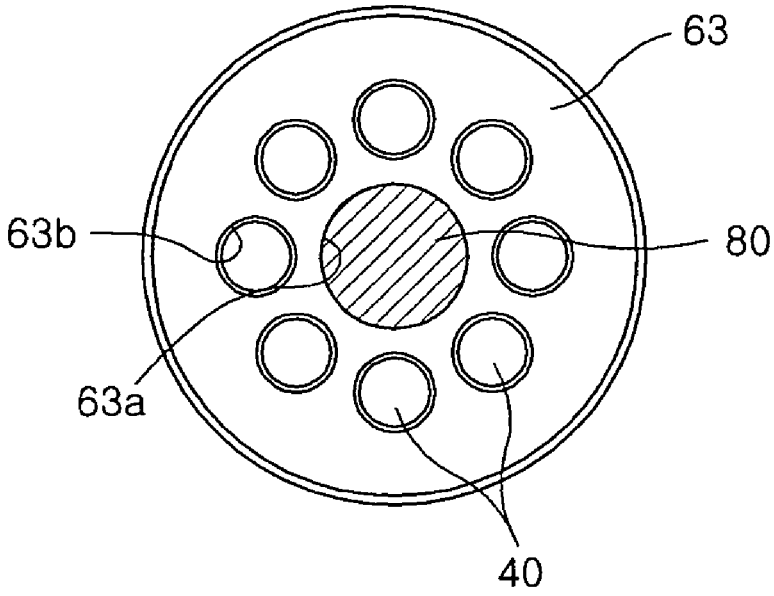
FIG. 4 is a bottom view of a separation preventing cover showing an arrangement condition of magnets according to the first embodiment of the present invention.
Figure 5:
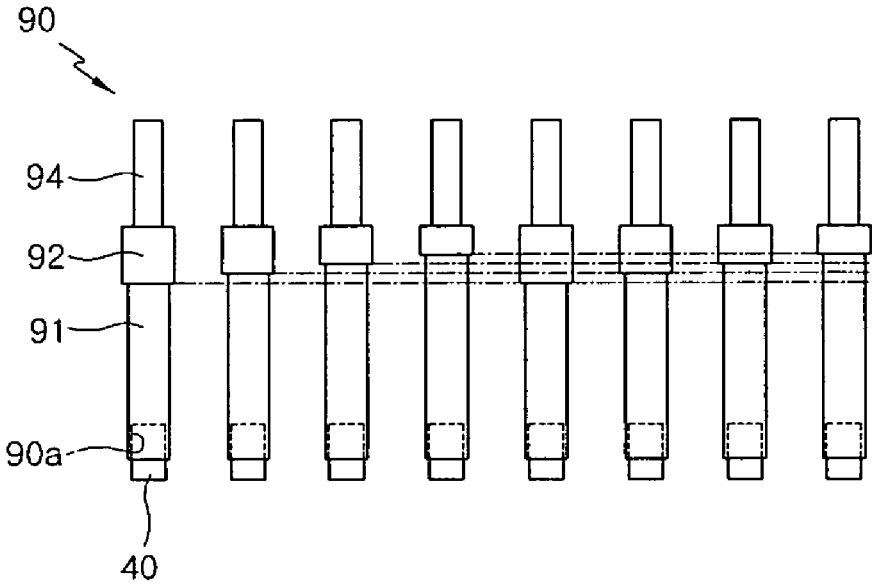
FIG. 5 is a side view of magnet fixtures according to the first embodiment of the present invention.
Figure 6:
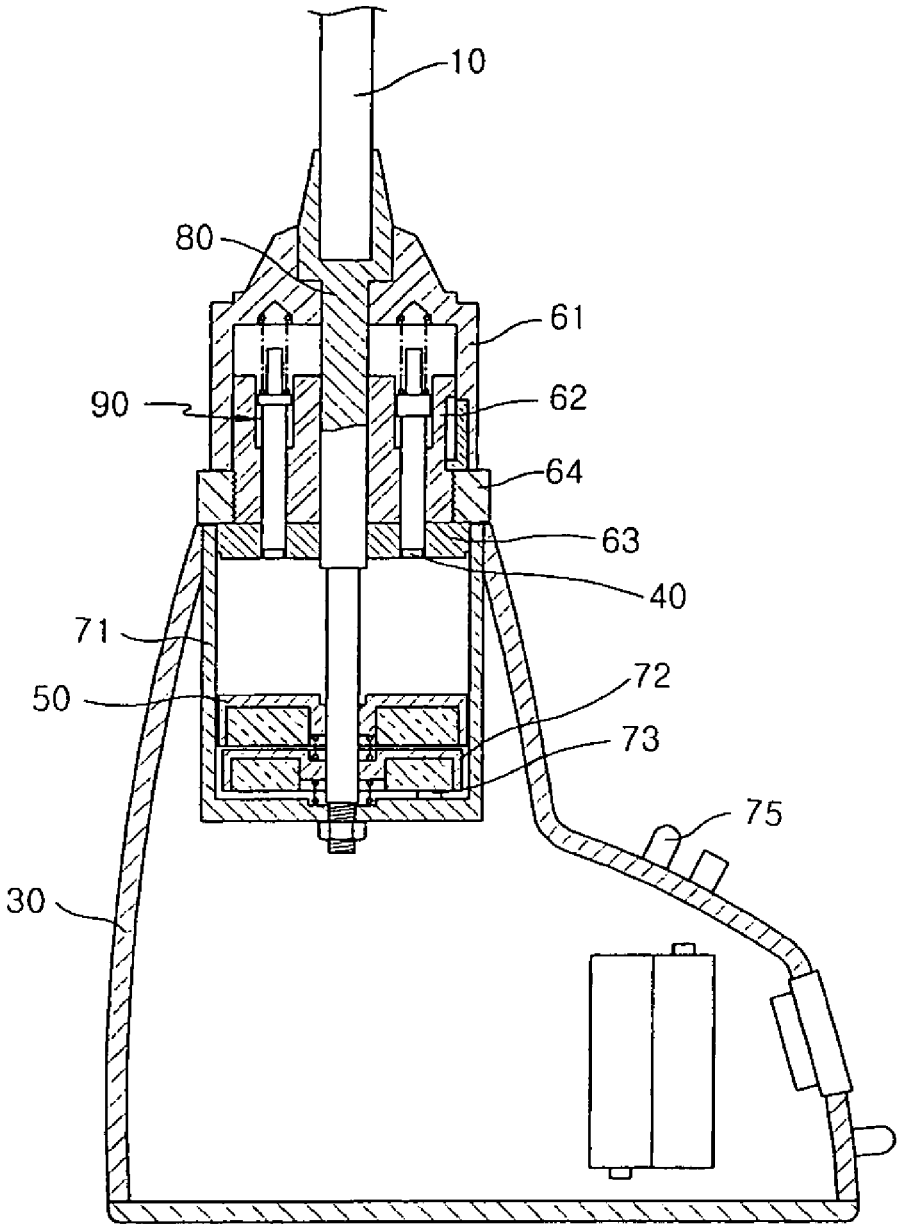
FIG. 6 is a cross-sectional view showing inner structures of main features according to the first embodiment of the present invention.

FIG. 1 is a perspective view of a training machine for golf swing according to a first embodiment of the present invention, FIG. 2 is an exploded perspective view of a training machine for golf swing according to the first embodiment of the present invention, FIG. 3 is a cross-sectional view of inner structures of main features shown in FIG. 1 and FIG. 2, FIG. 4 is a bottom view of a separation preventing cover showing an arrangement condition of a magnet according to the first embodiment of the present invention, FIG. 5 is a side view of magnet fixtures according to the first embodiment of the present invention, and FIG. 6 is a cross-sectional view of inner structures of main features according to the first embodiment of the present invention.

As shown in FIGS. 1 to 3, a training machine for golf swing according to an embodiment of the present invention comprises a club shaft 10 having a grip 20 at a top end thereof; a club head 30 engaged with a lower end of the club shaft 10; a plurality of magnets 40 provided on an opposite side of shaft 10 from grip 20 (in the opposite position to the grip 20); a magnetic body 50 attachable to the magnets 40, and adapted to be separated from the magnets by the centrifugal force of more than a prescribed intensity (threshold) and the instant swing speed upon swinging the machine; a magnetic force control means 60 associated with the magnets 40 and for controlling the intensity of magnetic force affecting the magnetic body 50 from the magnets 40; and an announcement means 70 positioned apart with the magnetic body 50, and for announcing the separation of the magnetic body 50 and the magnets 40 to contact the magnetic body when the magnetic body 50 is separated from the magnets 40.

As shown in FIG. 3, an extension shaft 80 to which the magnetic force control means 60 is fixed and the magnetic body 50 is movably set, is extended in the lower end of the club shaft 10.

The lower end of the extension shaft 80 is passed through an open top portion of the club head 30, inserted into the second frame 71 as will be mentioned below and passed into a bottom of the second frame 71. A thread portion 80*a* for engaging with a nut (n) is formed in the end of the extension shaft 80 passing through the bottom of the second frame 71.

Thus, after the thread portion 80*a* of the extension shaft 80 passes through the bottom of the second frame 71 fixed in the club head 30, the thread portion 80*a* will be engaged with the nut (n) (FIG. 2) through an open lower portion of the club head 30. If the nut (n) is tightened, a bottom surface of the magnetic force control means 60 fixed to the outside of the extension shaft 80 will be closed to the upper surface of the club head 30 and the upper surface of the second frame 71 as shown in the drawings, and then, the club shaft 10 and the club head 30 will be integrally engaged with each other.

As shown in FIG. 3, a space portion 30*a*, which is open above and below, is formed in an inner side of the club head 30. The open lower portion of the club head 30 can be detachably engaged with a head cover 31 for shielding an open lower portion of the club head 30.

As shown in FIGS. 3 and 4, the magnets 40 are exposed to the bottom of the separation preventing cover 63 to generate a magnetic force and fix the magnetic body 50. The magnets are preferably provided in an even number. Each set of the two magnets is positioned symmetrically around the extension shaft 80.

As shown in FIGS. 2 and 3, the magnetic body 50 is preferably made of iron that can be attached to the magnets. The magnetic body is elastically supported in the second frame 71 by means of a spring 51. The magnetic body will be moved upwardly and attached to the magnet 40 exposed to the bottom of the separation preventing cover 63 when no swing has occurred. The magnetic body will be separated from the magnets 40 and moved downwardly by the centrifugal force and the instant speed of the swing when swing has occurred as shown in FIG. 6. The magnetic body functions as a collision means for colliding with the collision plate 72.

Meanwhile, a shaft perforating hole 50*a* into which the extension shaft 80 passes is formed in the center of the magnetic body 50.

As shown in FIGS. 2 and 3, the magnetic force control means 60 includes a first frame 61 fixed to an outside of the upper end portion of the extension shaft 80, a circular sliding member 62 positioned slidably in the first frame 61, a separation preventing cover 63 fixed to the outside of the extension shaft 80 away from the first frame 61 for preventing the sliding member 62 from being separated downwardly, and a control handle 64 threaded to the lower portion of the sliding member 62.

The first frame 61 is securely fixed to the outside of the upper end portion of the extension shaft 80 by an adhesive, etc. The first frame is formed in a general cylindrical shape and has a space portion 61*a*, which is open below.

In addition, the sliding member 62 is formed in a general circular cylindrical shape. A shaft perforating hole 62*a* through which the extension shaft 80 passes is formed in the center of the sliding member, and a thread with which a control handle 64 can be engaged is formed on an outside of the lower portion of the sliding member.

The sliding member 62 is provided with a plurality of fixture perforating holes 62*b*, which are concentrically spaced and allow the magnet fixture 90 for fixing a plurality of the magnets to pass through. The upper part of the sliding member 62 is provided with a plurality of locking grooves 62*c* to which are formed for connecting the fixture perforating holes 62*b* and a locking portion 92 of the magnet fixture 90 as mentioned below is locked when the sliding member 62 is moved upwardly by controlling the control handle 64.

Thus, when the sliding member 62 is moved upwardly by turning the control handle 64, the magnet fixture 90 is moved upwardly together with the sliding member 62 as the locking portion 92 of the magnet fixture 90 is locked to a bottom of the locking groove 62*c*.

The center of the separation preventing cover 63 is provided with a shaft perforating hole 63*a* into which the extension shaft 80 passes as shown in FIG. 4. In the periphery of the shaft perforating hole 63*a*, a plurality of fixture perforating holes 63*b* through which the magnet fixture 90 passes and magnets 40 are exposed toward the bottom, are concentrically formed at regular intervals.

The control handle 64 controls the intensity of the magnetic force that affects the magnetic body 50 from the magnets 40 by adjusting the degree of sliding of the sliding member 62. The control handle is engaged with an outside of the lower part of the sliding member 62 whereby the up and down movement thereof is suppressed by the first frame 61 and the separation preventing cover 63.

Because the control handle 64 is turned under the condition that its up and down movement is suppressed by the first frame 61 and the separation preventing cover 63, the sliding member 62 slides relatively along with the space portion 61*a* of the first frame 61 upon the rotation of the control handle 64.

As shown in FIGS. 3 and 5, the magnet fixture 90 for fixing the magnets 40 includes a magnet fixing element 91 comprised of a cylindrical shape, passing through the sliding member 62 and the separation preventing cover 63 and having a magnet fixing groove 90*a* at the lower end of which magnets are fixed, a locking portion 92 integrally formed at an upper end of the magnet fixing element 91 and adapted to be locked to the bottom of the locking groove 62*c* upon the rising of the sliding member 62, the cross-sectional area of the locking portion 92 being greater than the cross-sectional area of the magnet fixing element 91, a spring 93 having an upper end and a lower end, the upper end of the spring being fixed to a fixing groove 61*b* formed at the upper surface of the space portion 61*a* of the first frame 61 and the lower end of the spring being inserted into a locking groove 62*c* of the sliding member 62 for applying force to press the locking portion 92 downwardly, and a spring guide portion 94 extended from the upper surface of the locking portion 92 for guiding the spring 93 positioned at an outside of the spring guide portion 94 such that the elastic force of the spring 93 can be accurately applied to the locking portion 92.

Then, in like manner of the magnet, the magnet fixtures 90 are provided in an even number, and each set of the two magnet fixtures is positioned concentrically around the extension shaft 80. As shown in FIG. 5, the top heights of the magnet fixing element 91 and the locking portion 92 of the magnet fixtures 90 which are symmetrically positioned with each other are the same whereas the bottom heights of the magnet fixing element 91 and the locking portion 92 of the magnet fixtures 90 which are neighboring are different from each other.

Therefore, if the sliding member 62 is moved upwardly by adjusting the control handle 64, the symmetrical magnet fixtures 90 will be equally moved upwardly while the neighboring magnet fixtures 90 will be moved upwardly at different intervals. Thus, according to the degree of the rising of the sliding member 62, the number of the magnets 40 exposed toward the bottom of the separation preventing cover 63 will be varied, and thus, the magnetic force for fixing the magnetic body 50 will be varied.

That is, under the condition that the sliding member 62 is positioned at the lowest position thereof, all of the magnets 40 are exposed toward the bottom surface of the separation preventing cover 63 and then the distance between the magnets and the magnetic body 50 will be minimized whereby the magnetic force of the magnets 40 affecting the magnetic body 50 will be maximized. As a result, in order to separate the magnetic body 50 from the magnets 40, the centrifugal force more than a prescribed intensity and the instant speed of swing must be generated, and thereby the magnetic body 50 can be separated from the magnets 40.

On the contrary, if the sliding member 62 is moved upwardly, the magnets 40 will be sequentially moved upwardly and be gradually apart from the magnetic body 50. As a result, the intensity of magnetic force for fixing the magnetic body 50 will be gradually weakened and thus the force required for separating the magnetic body 50 from the magnets 40 will be lowered.

Thus, the intensity of magnetic force can be controlled by operating the control handle 64 and regulating the degree of rising of the sliding member 62. That is, more intensive centrifugal force and instant swing speed are needed in order to hit a ball far, and thus, the sliding member 62 should be positioned at the lowest position thereof such that the magnetic force affecting the magnetic body 50 can be maximized. On the contrary, less swing force is needed in order to hit a ball shortly and thus, the sliding member 62 should be positioned at the highest position thereof such that the magnetic force affecting the magnetic body 50 can be minimized.

The reason that the lengths of the magnet fixing elements 91 and the locking portions 92 of the symmetrical magnet fixtures 90 are equal to each other and the symmetrical magnet fixtures 90 are made so as to move up and down simultaneously is for attaching the magnetic body 50 to the magnets 40 precisely so as to apply the same magnetic force to both sides of the magnetic body 50.

As shown in FIG. 3, the announcement means 70 includes a second frame 71 positioned in an inner side of the club head 30, and a collision plate 72 positioned in the second frame 71 and adapted to be collided with the magnetic body 50 which is separated from the magnet 40 upon the swing.

The second frame 71 is fixed to an upper side of the space portion in the club head 30 and formed in a cylindrical shape. The inside of the second frame is provided with the space portion 71*a* which is open to the top, and the center of the bottom of the second frame is provided with a shaft perforating hole 71*b* through which an end of the extension shaft 80 can pass. The magnetic body 50 is positioned movably up and down within the space portion 71*a* of the second frame 71.

The collision plate 72 is elastically supported within the space portion 71*a* of the second frame 71 by a spring 73 positioned below the magnetic body 50. The magnetic body 50 is elastically supported by the spring 51 at an upper part of the collision plate 72. The shaft perforating hole 72*a* through which the extension shaft 80 passes is positioned in the center of the collision plate 72.

Thus, as shown in FIG. 6, if the magnetic body 50 is separated from the magnets 40 and then moved downwardly by the centrifugal force more than a prescribed intensity and the instance swing speed caused due to the swing, the spring 51 supporting the magnetic body 50 will be pressed simultaneously with the collision of the magnetic body 50 with the collision plate 72, and then the collision plate 72 will be moved downwardly due to the force of collision with the magnetic body 50 and the repulsive force of the spring 51.

Meanwhile, a first lighting switch 74 (FIG. 3) is positioned on a bottom surface of the second frame 71 and adapted to be contacted with the collision plate 72 when the collision plate 72 is moved downwardly. The first lighting switch 74 is connected with a swing LED 75 positioned on the outside of the club head 30 and operated to turn on the swing LED 75 upon the contact.

As shown in FIG. 3, a side portion of the first frame 61 is provided with a sliding switch 100 which can generate different signals according to the degree of rising of the sliding member 62 when the sliding member 62 is moved upwardly by operating the control handle 64, the outside of the club head 30 is provided with a display window 110 which can display driver distances upon the operation of the sliding switch 100, and the inside of the club head 30 is provided with a control portion 120 for controlling display of driver distances on the display window 110 according to the signals transmitted and received upon the operation of the sliding switch 100.

In addition, the outside of the club head 30 is provided with a plurality of trace identifying LEDs 130 through which swing traces upon the swing can be identified with the naked eye, and a second lighting switch 140 for lightening the trace identifying LEDs 130.

A swing LED 75, a display window 110 and a battery 150 for applying power to the trace identifying LEDs 130 are provided in the club head 30.

The first lighting switch 74, the swing LED 75, the sliding switch 100, the display window 110, the control portion 120, the trace identifying LEDs 130, the second lighting switch 140 and the battery 150 are electrically connected although their electrical connections are not shown in the drawing.

The operation of the training machine for golf swing according to an embodiment of the present invention as constructed above will be now described in detail.

First, the magnetic body 50, the spring 51, the collision plate 72 and the spring 73 are fitted into the extension shaft 80 in regular order. Thereafter, the extension shaft 80 is inserted into the space portion 71*a* of the second frame 71 through an open upper part of the club head 30. Then, the thread portion 80*a* formed on the end of the extension shaft 80 is passed through the shaft perforating hole 71*b*, and tightened to the nut (n). As a result, the club shaft 10 and the club head 30 can be integrally engaged each other.

Then, if the nut (n) is tightened, the control handle 64 will be adhered closely to the upper part of the second frame 71 and the upper surface of the club head 30 without inserting into the second frame 71.

Like this, if the assembly of the training machine for golf swing according to the embodiment of the present invention is completed, a user can grasp the grip 20 and train of his/her golf swing.

Before the user trains their golf swing, the user can adjust the intensity of magnetic force affecting the magnetic body 50 from the magnets 40 by rotating the control handle 64 to conform to the distance that he/she wants to train.

If the control handle is rotated, the sliding member 62 will be moved upwardly, and then the sliding switch will be operated to send a signal to the control portion 120. Thereafter, the distance corresponding to the intensity of magnetic force affecting the magnetic body 50 is displayed in figures on the display window 110 of the club head 30 by the control portion 120.

Thus, in order to extend the distance of hit, the intensity of swing should be increased as much. In this case, the sliding member 62 is positioned at the lowest position thereof such that all of the magnets 40 can be exposed to the bottom surface of the separation preventing cover 63. As a result, the intensity of magnetic force will be maximized. In order to shorten the driver distance, the intensity of swing should be weakened as much. In this case, the sliding member 62 can be moved upwardly, and then, a part or all of the magnets 40 can be moved upwardly. As a result, the distance from the magnets 40 to the magnetic body 50 will be minimized and thus, the intensity of magnetic force will be weakened.

Like this, a user can grasp the grip 20 and swing a club after setting the driver distance by operating the control handle 64. As shown in FIG. 6, since the centrifugal force generated at an initial stage of swing will be controlled by the magnetic force, when the centrifugal force is more than a prescribed intensity and the instant swing speed is generated, the magnetic body 50 will be separated from the magnet 40 and moved downwardly. Thereafter, because the magnetic body 50 will collide with the collision plate 72 concurrently with the drop of the collision plate 72, the user can feel the precise impact.

Like this, if the magnetic body 50 and the collision plate 72 is dropped down, the first lighting switch 74 positioned on the bottom of the space portion 71*a* of the second frame 71 will be contacted to the collision plate 72. Thereafter, the swing LED 75 will be lighted when power of the battery 150 is applied to the swing LED 75.

That is, because the lighting of the swing LED 75 can be confirmed with the naked eye, the training for preventing the head up that a user lifts his head upon swing can be carried out. Thus, if the swing LED 75 was not lighted, it means that the precise impact has not been carried out upon the swing. If the precise impact was carried out and the swing LED 75 was lighted but the user did not confirm the instant of the lighting of the swing LED, it means that a head up has broken out (lifted their head during the swing). Thus, the user can train the precise impact and the prevention of head up at the same time.

The user can confirm traces of the swing with the naked eye through the lighting of the trace identifying LED 130 by an operation of the second lighting switch 140 before swing. Thus, the user can train correct swing postures.

If the swing is completed and then the centrifugal force is removed, the magnetic body 50 and the collision plate 72 will be returned to original positions by the spring 51, 73. The magnetic body 50 will be fixed to the magnets 40, which are exposed to a bottom of the separation preventing cover 63. Thereafter, the contact of the first lightening switch 74 is released and then the swing LED 75 is turned off.

Figure 7:
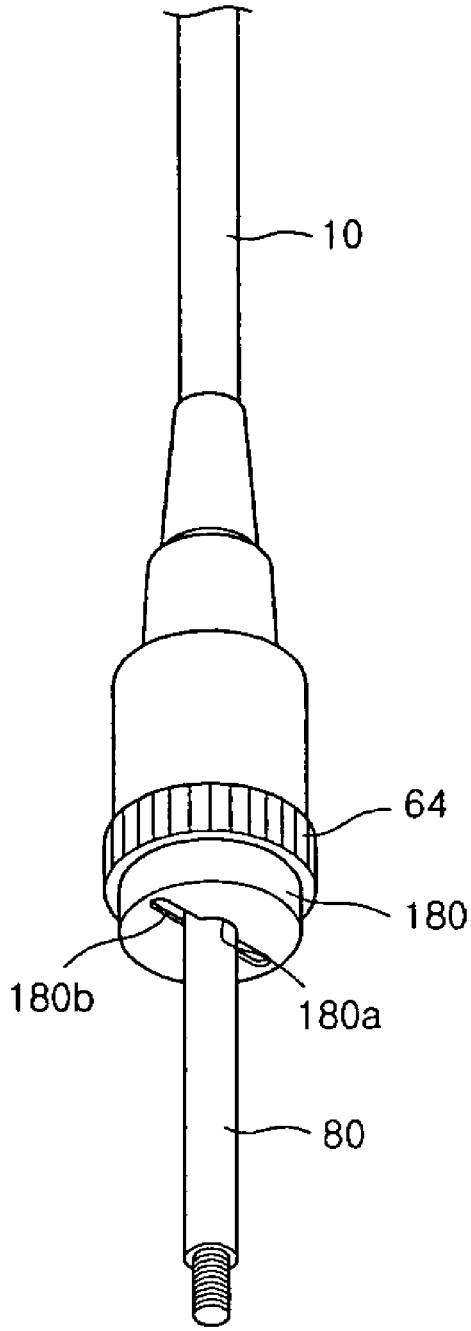
FIG. 7 is a perspective view showing a part of constitutional elements according to a second embodiment of the present invention.
Figure 8:
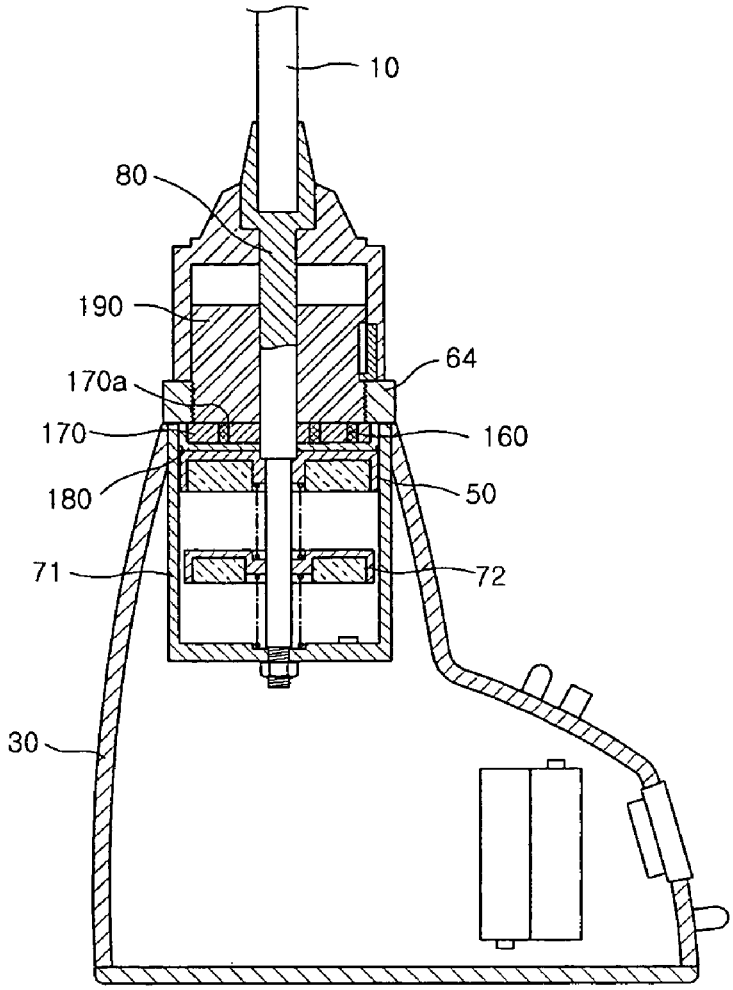
FIG. 8 is a cross-sectional view showing inner structures of main features including the constitutional elements shown in FIG. 7.
Figure 9:
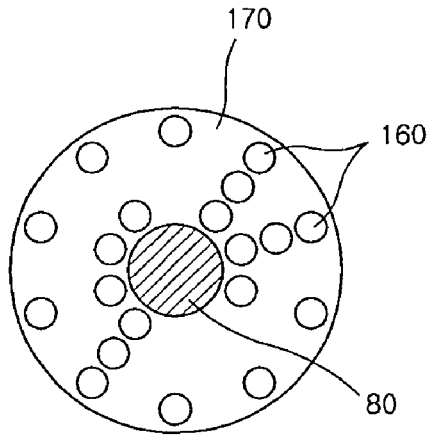
FIG. 9 is a bottom view of a separation preventing cover showing arrangement condition of magnets according to the second embodiment of the present invention.
Figure 10A:
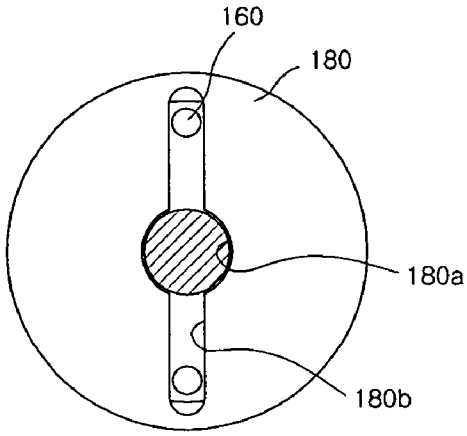
FIGS. 10*a* to 10*e* are views showing a plurality of types of the arrangements that the magnets are exposed by a magnet exposure cover shown in FIGS. 7 and 8.
Figure 10B:
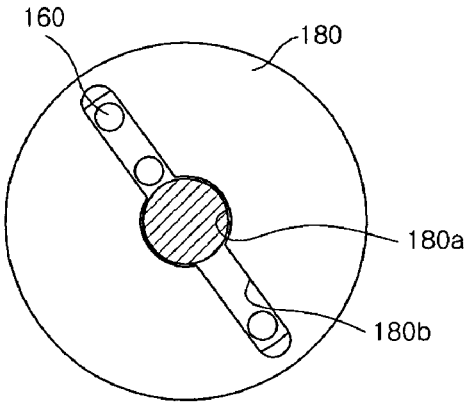
Figure 10C:
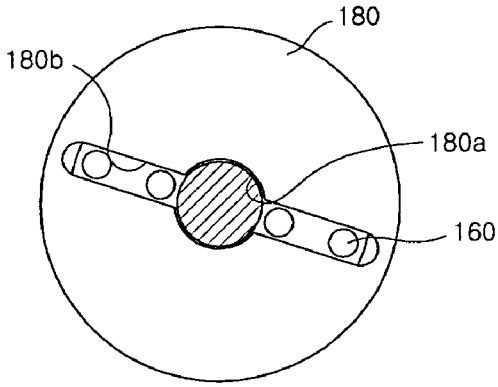
Figure 10D:
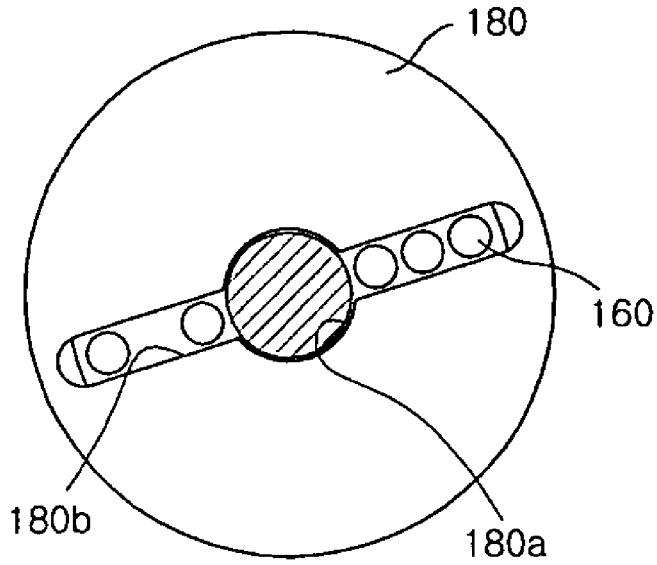
Figure 10E:
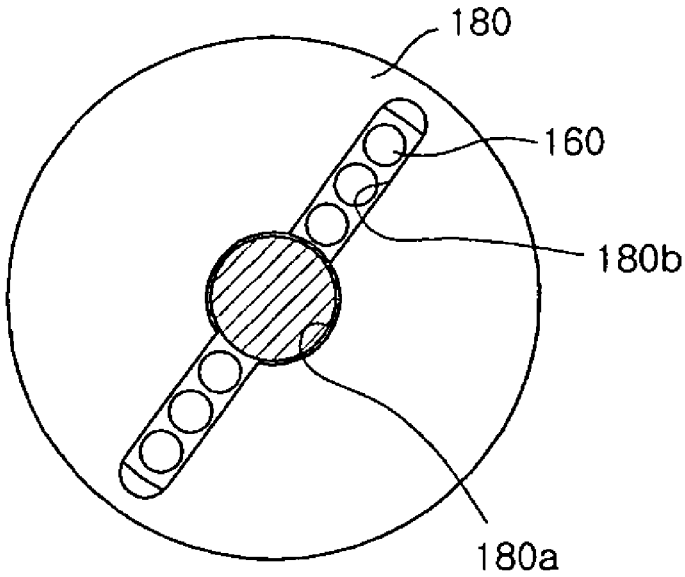

FIG. 7 is a perspective view showing a part of constitutional elements according to a further embodiment of the present invention. FIG. 8 is a cross-sectional view of inner structures of main features including the constitutional elements shown in FIG. 7. FIG. 9 is a bottom view of a separation preventing cover showing arrangement condition of a magnet according to a further embodiment of the present invention. FIGS. 10*a* to 10*e* are views showing a plurality of types of the arrangements that the magnets are exposed by a magnet exposure cover shown in FIGS. 7 and 8. Herein, the same reference numerals as the reference numerals in FIGS. 1 to 6 indicate the same constitution elements having the same functions.

As shown in FIG. 8, the magnets 160 of the training machine for golf swing according to a further embodiment of the present invention are directly fixed to a magnet fixing hole 170*a* formed in a separation preventing cover 170 without being fixed by a separate fixture like the first embodiment of the present invention.

As shown in FIG. 9, each of the magnets 160 is positioned radially around the extension shaft 80 on the separation preventing cover 170, provided preferably in an even number of rows, and each of the two rows are symmetrically positioned with each other. When the two rows positioned symmetrically with each other form one group, a different number of the magnets will be included in each of the neighboring groups and thus the intensity of the magnetic force will be varied in each of the groups.

Furthermore, as shown in FIGS. 7 and 8, an exposure cover 180 is integrally engaged with the control handle 64 such that the exposure cover 180 can be rotated with the control handle 64 under the condition of surrounding the separation preventing cover 170 below the control handle 64. A shaft perforating hole 180*a* through which the extension shaft 80 can pass is formed in the center of the exposure cover 180. A magnet exposing hole 180*a* for exposing the magnets is formed in a straight line such that the shaft perforating hole 180*a* is positioned in the center thereof. The exposure cover 180 is made of diamagnetic material such as synthetic resin, etc.

Thus, as shown in FIGS. 10*a* to 10*e*, the intensity of the magnetic force that affect the magnetic body 50 from the magnets 160 can be controlled by rotating the control handle 64 and adjusting a degree of exposure of the magnets 160.

In the present embodiment, because a magnet fixture is not required, the sliding member 190 slid by the control handle 64 does not require a fixture perforating hole and a locking groove as provided in the first embodiment of the present invention.

Because an operation of the training machine for golf swing according to the further embodiment of the present invention is generally equal to that of the first embodiment with the exception of a procedure of adjusting the magnetic force affecting the magnetic body 50 from the magnets 160, the description thereto will be omitted.

According to the training machine for golf swing of the present invention as constructed above, since the centrifugal force generated at the initial stage of swing can be controlled by the magnetic force, and the magnetic body may be separated from the magnets only when the centrifugal force more than the prescribed intensity is generated and the swing speed reaches the highest point, the user can feel and realize the precise impact. In addition, the user can control the intensity of swing by adjusting the intensity of the magnetic force affecting the magnetic body in accordance with the distance by the degree of which the user wants to hit a ball.

In particular, because the user can confirm the desired driver distance through the display window with the naked eye, the user can train the intensity of swing more precisely. In addition, from the sound generated when the magnetic body collides with the collision plate and the lighting of the swing LED when the collision is contacted with the first lighting switch, the user can confirm whether the precise impact was made or not and also prevent a head up that a user lifts his head upon the swing.

Furthermore, the user can confirm traces of swing with the naked eye by setting up the trace identifying LED in the club head. Thus, the user can train correct swing postures.

As mentioned above, while the training machine for golf swing according to the preferred embodiments of the present invention has been described with reference to the drawings attached hereto, it is to be understood that the present invention should not be limited to the embodiments and drawings and various modifications may be made without deviating from the scope of the concept of the present invention.

What is claimed is:

1. A training machine for golf swing including a club shaft having a grip at a top end thereof, and a club head engaged with a lower end of the club shaft, comprising:

a plurality of magnets provided in an opposite position relative to a grip end of a shaft;

a collision means attachable to the magnets, and adapted to be separated from the magnets and collided with other objects by a centrifugal force of more than a prescribed amount and an instant swing speed upon swinging the shaft;

a magnetic force control means associated with the magnets and for controlling the intensity of magnetic force affecting the collision means from the magnets; and an announcement means positioned apart from the collision means, and for announcing the separation of the collision means and the magnets to contact the collision means when the collision means is separated from the magnets, whereby a user easily confirms by the announcement means whether a swing more than the prescribed intensity was made to correspond to the intensity of magnetic force controlled by the magnetic force control means.

2. The training machine for golf swing of claim 1, further comprising an extension shaft extended from the lower end of the club shaft, the magnetic force control means being fixed to an outside of the extension shaft and the collision means being movably positioned on the extension shaft.

3. The training machine for golf swing of claim 2, wherein the magnetic force control means includes a first frame fixed to an outside of the upper end of the extension shaft and having a first space portion positioned and open below therein; a circular sliding member positioned and slidable in the first frame and for moving the magnets upwardly; a separation preventing cover positioned away from the first frame, fixed to the outside of the extension shaft for preventing the sliding member from being separated downwardly, and for exposing the magnets toward a bottom surface thereof; and a control handle engaged and threaded with the outside of the sliding member under the condition that the up and down movement of the control handle is suppressed by the first frame and the separation preventing cover, and for controlling the intensity of the magnetic force affecting the collision means from the magnets along with sliding of the sliding member.

4. The training machine for golf swing of claim 3, further comprising a plurality of magnet fixtures for fixing each of the magnets such that the magnets are moved upwardly together with the sliding member when the sliding member is slid by adjusting the control handle.

5. The training machine for golf swing of claim 4, wherein the magnet fixtures includes a magnet fixing element passing through the sliding member and the separation preventing cover and for fixing the magnets to a lower end of the magnet fixing element; a locking portion formed integrally at an upper end of the magnet fixing element and adapted to be locked to a bottom of a locking groove formed in an upper part of the sliding member when the sliding member is moved upwardly, a cross-sectional area of the locking portion being greater more than a cross-sectional area of the magnet fixing element; and a first spring for applying force to press the locking portion downwardly and having upper and lower ends such that the upper end of the spring is fixed to a fixing groove formed at the upper surface of the space portion of the first frame and the lower end of the spring is inserted into the locking groove of the sliding member.

6. The training machine for golf swing of claim 5, wherein the magnet fixtures are provided in an even number concentrically around the extension shaft, each set of the two magnet fixtures is arranged symmetrically with each other, and heights of the magnet fixing element and the locking portion of the magnet fixtures which are symmetrically positioned with each other are the same on one side whereas the heights on the other side of the magnet fixing element and the locking portion of the magnet fixtures which are neighboring each other are different.

7. The training machine for golf swing of claim 6, further comprising a spring guide portion extended from the upper surface of the locking portion and for guiding the first spring positioned at the outside of the spring guide portion such that an elastic force of the first spring is accurately applied to the locking portion.

8. The training machine for golf swing of claim 3, wherein the magnets are positioned radially around the extension shaft above the separation preventing cover, provided in an even number of rows around the extension shaft, each of the two rows is symmetrically positioned with each other, and the magnets are arranged such that, when the two rows symmetrically positioned each other are to be one group, a different number of the magnets is included in each of the neighboring groups and thereby the intensity of the magnetic force is varied in each of the groups.

9. The training machine for golf swing of claim 8, further comprising an exposure cover made of diamagnetic material, and the exposure cover is positioned under the control handle such that the exposure cover is rotated with the control handle under the condition that the separation preventing cover is surrounded, and a shaft perforating hole through which the extension shaft passes and a magnet exposing hole for exposing the magnets are formed in the bottom of the exposure cover.

10. The training machine for golf swing of claim 3, wherein the announcement means includes a second frame positioned in an inner side of the club head and having a second space portion opened upwardly therein such that the collision means is moved upwardly and downwardly within the second space portion; and a collision plate positioned below the collision means in the second frame such that the collision plate is collided with the collision means which is separated from the magnets upon the swing.

11. The training machine for golf swing of claim 10, wherein the collision means is supported elastically by a second spring such that the collision means is returned to the original position and then attached to the magnets by the elastic force of the second spring after the centrifugal force is removed.

12. The training machine for golf swing of claim 11, wherein the collision plate is supported elastically by a third spring such that the collision plate is moved downwardly when the collision plate collides with the magnetic body, and the collision plate is returned to the original position by the third spring when the centrifugal force is removed.

13. The training machine for golf swing of claim 12, wherein a first lighting switch is positioned on the bottom of the second frame and adapted to be lighted by the contact with the collision plate which is moved downwardly upon the swing, a swing LED is positioned on the outside of the club head for being lighted by the contact with the first lighting switch, and a battery for applying power to the swing LED is provided in the club head.

14. The training machine for golf swing of claim 3, wherein a sliding switch which generates different signals according to the degree of rise of the sliding member is positioned above the control handle, a display window which displays distances upon the operation of the sliding switch is positioned at the outside of the club head, and a control portion for converting signals from the sliding switch to distances is positioned in the club head.

15. The training machine for golf swing of claim 1, wherein at least one or more trace identifying LEDs through which swing traces upon the swing is identified with the naked eye and a second lighting switch for lighting the trace identifying LEDs are provided on the outside of the club head, respectively, and a battery for applying power to the trace identifying LEDs is provided in the club head.

* * * * *